US005645692A

United States Patent [19]

Gourlia et al.

[11] Patent Number: 5,645,692

[45] Date of Patent: Jul. 8, 1997

[54] PROCESS FOR THE STABILIZATION OF CRUDE OILS AT THE OUTLET OF THE EXTRACTION WELL AND DEVICE FOR IMPLEMENTATION THEREOF

[75] Inventors: Jean-Paul Gourlia, La Mulatiere; Jacques Tournier Lasserve, Pau; Georges Bihn-Cirlot, Couladiere; Jean Vandermeersch, Montreuil Sous Bois, all of France

[73] Assignee: Elf Aquitaine Production, Courbevoie, France

[21] Appl. No.: 406,908

[22] PCT Filed: Jul. 28, 1994

[86] PCT No.: PCT/FR94/00950

§ 371 Date: Jun. 26, 1995

§ 102(e) Date: Jun. 26, 1995

[87] PCT Pub. No.: WO95/04116

PCT Pub. Date: Feb. 9, 1995

[30] Foreign Application Priority Data

Jul. 30, 1993 [FR] France ..... 93 09459

[51] Int. Cl.[6] ..... C10C 1/04; B01D 3/14

[52] U.S. Cl. ..... 196/46; 196/99; 196/100; 196/139; 202/158; 202/182; 203/87

[58] Field of Search ..... 196/46, 99, 100, 196/139; 202/153, 158, 176, 182, 185.1; 203/82, 84, 87

[56] References Cited

U.S. PATENT DOCUMENTS

| | | | |
|---|---|---|---|
| 3,091,586 | 5/1963 | Pappas et al. | 196/46 |
| 3,297,566 | 1/1967 | Moyer et al. | 196/99 |
| 3,320,159 | 5/1967 | Potts | 196/99 |
| 3,819,511 | 6/1974 | Peiser et al. | 196/99 |
| 4,406,743 | 9/1983 | MacQueen et al. | 196/46 |

*Primary Examiner*—Christopher Kim

*Attorney, Agent, or Firm*—Oblon, Spivak, McClelland, Maier & Neustadt, P.C.

[57] ABSTRACT

A method and apparatus for stabilizing crude oil at the outlet of a well, including at least one separation step wherein the crude oil is pressure distilled in at least one distillation column into at least two cuts, i.e., a $C_{1-5}$ hydrocarbon gas cut recovered at the top of the column and a stabilized crude oil cut recovered below the point where the original crude oil was injected into the column. The method advantageously includes at least one decompression step before the separation step.

29 Claims, 3 Drawing Sheets

PROCESS FOR THE STABILIZATION OF CRUDE OILS AT THE OUTLET OF THE EXTRACTION WELL AND DEVICE FOR IMPLEMENTATION THEREOF

This application is a 371 of PCT/FR94/00950, filed Jul. 28, 1994.

TECHNICAL FIELD

The present invention relates to a process for the stabilization of crude oils at the outlet of the extraction well and to the device for implementation of the process.

BACKGROUND ART

Process for the stabilization of crude oils is understood to mean the operation which consists in bringing the flowing pressure of the crude oil at the well outlet, generally of between 10 and 100 bars, to atmospheric pressure, a Reid vapor pressure of the order of 0.69 bar at 38° C., determined by the API standard D323, being observed, while limiting losses to the atmosphere of light hydrocarbons, especially $C_3^+$ hydrocarbons, that is to say consisting of three to seven carbon atoms, commonly known as $C_3$, $C_4$, $C_5$, $C_6$ and $C_7$ hydrocarbons. The aim of such a process is, of course, to maximize the production of crude oil while attempting to recover the maximum of $C_3^+$ but while obtaining a stabilized crude oil which does not degas or which only degasses very slightly.

Currently, in order to stabilize a crude oil on an oil field, a process involving a number of successive flashes is used. This is a process of decompression in a number of stages, which makes it possible to lower the pressure of the crude oil, which is mainly accompanied by not always controllable degassing of the lightest $C_3^-$ hydrocarbons, that is to say hydrocarbons consisting of less than three carbon atoms, i.e. $C_3$, $C_2$ and $C_1$. However, it is impossible, by successive flashes, to degas the crude oil while being limited solely to $C_3^-$ hydrocarbons; inevitably, $C_3^+$ hydrocarbons are entrained in the gases which are not recovered and $C_3^-$ hydrocarbons remain diluted in the crude oil. This process by flashes does not make it possible to selectively separate $C_3^-$ hydrocarbons from the crude oil without degassing other products with a higher added value. The presence of $C_3^-$ in the stabilized crude oil makes it more sensitive to temperature and pressure variations during subsequent operations, since the $C_3^-$ can degas inopportunely.

This problem of the subsequent degassing of crude oil, especially during its storage or its transportation, either by boat or by pipeline, can be the source of many difficulties and especially of possible accidents.

DISCLOSURE OF THE INVENTION

The aim of the present invention is therefore to obtain a stabilized crude oil in which a maximum of $C_4^+$ hydrocarbons, that is to say $C_4$ to $C_7$ hydrocarbons, which are generally not completely recovered by the techniques known to those skilled in the art, will be recovered and the amount of $C_3$ hydrocarbons will be adjusted with a view to obtaining the optimum Reid vapor pressure for its subsequent storage or transportation.

The subject of the present invention is therefore a process for the stabilization of crude oils at the outlet of the extraction well, characterized in that it comprises at least one separation stage which comprises distilling the virgin crude oil arising from the extraction well under pressure in at least one distillation column as at least two cuts, including a gaseous $C_1$ to $C_5$ hydrocarbon cut recovered at the head of the column and a stabilized crude oil cut recovered below the injection point of the crude oil into the column.

In a first embodiment of the invention, when the virgin crude oil is distilled as two cuts, the stabilized crude oil cut is drawn off at the bottom of the column.

In the process of the present invention, the distillation is carried out in a conventional way known to those skilled in the art, whether the column is fitted with trays or comprises packings. Thus, a liquid reflux will be created at the head of the column and an upward vapor flow, countercurrentwise to the liquid reflux, will be created at the bottom of the column.

However, in contrast to the known art, instead of condensing all the gaseous cut before reinjecting it at the head of the column in order to create the reflux, the gaseous cut will be selectively separated into two fractions, one comprising light $C_3^-$ hydrocarbons and the other $C_4$ and $C_5$ hydrocarbons and a portion of the $C_3$ hydrocarbons. Only the fraction containing the $C_4$ and $C_5$ hydrocarbons is recovered, then condensed and finally reinjected at the head of the column. This selective separation into two $C_3^-$ hydrocarbon and $C_4$ and $C_5$ hydrocarbon fractions is obtained especially by cryogenics, by adsorption/desorption, by membrane separation of the gases and/or by any other means which makes it possible to selectively separate these gases.

In the same manner, in order to create the upward vapor flow, reinjection is carried out, at the bottom of the column, of a portion of the stabilized crude oil drawn off at the bottom of the column after evaporation of the latter.

In this configuration, the part of the column situated above the injection point of the virgin crude oil has the function of separating the $C_1$ to $C_5$ hydrocarbons from the heavier hydrocarbons. The part of the column situated below this said injection point has the function of removing the $C_1$ and $C_2$ hydrocarbons and a portion of the $C_3$ hydrocarbons from the crude oil, which makes it possible to adjust the vapor pressure of the stabilized crude oil.

However, in order to avoid any problems related to the strong decompression of the virgin crude oil exiting from the well within the column, the process according to the invention will advantageously comprise at least one decompression stage before the separation stage. This decompression stage will comprise partially degassing the said virgin crude oil, absorbing essentially the $C_4$ to $C_7$ hydrocarbons, vaporized during the degassing, in a hydrocarbon absorption liquid which is stable at the pressure and the temperature of the chamber, mixing said absorption liquid laden with the recovered $C_4$ to $C_7$ hydrocarbons with the degassed crude oil and separating by settling a portion of the formation water extracted from the well with the said virgin crude oil.

The various operations can be carried out simultaneously in the same chamber or in separate chambers.

In this decompression stage according to the invention, the crude oil is decompressed for a degree of decompression corresponding to the ratio of the inlet pressure to the outlet pressure of the crude oil of between 1 and 7.

In the process of the invention, the absorption liquid is introduced countercurrentwise to the gas flow in order to trap the $C_4$ to $C_7$ hydrocarbons degassed during the decompression of the crude oil.

The absorption liquid according to the invention is a hydrocarbon from the group consisting of the distillation cuts of the stabilized crude oil and the stabilized crude oil itself.

In a second preferred mode of the invention, for a stabilization process comprising both a decompression stage and a separation stage, the virgin crude oil entering into the column is distilled as at least three cuts, a gaseous $C_1$ to $C_5$ hydrocarbon cut drawn off at the head of the column, then a stabilized crude oil cut drawn off from the median part of the column and finally a heavy hydrocarbon cut drawn off at the bottom of the column and mostly comprising hydrocarbons having at least eight carbon atoms per molecule.

It is possible, in this last heavy cut, to tolerate the presence of lighter $C_6$ and $C_7$ hydrocarbons.

In this preferred mode, as when there was no decompression stage, the gaseous cut is fractionated so as to be able to create, at the head of the column, a liquid reflux of $C_4$ and $C_5$ hydrocarbons containing a small amount of $C_3$ hydrocarbons.

A portion of the heavy hydrocarbon cut drawn off is vaporized and then reinjected into the column with a view to creating the rising vapor flow necessary for the good operation of the distillation column. This heavy cut, drawn off at the bottom of the column, is, virtually in its entirety, advantageously recycled as absorption liquid for the decompression stage which avoids any consumption of an additional product which generates additional operating costs.

In order to have an adjustment of the vapor pressure of the stabilized crude oil, it is possible optionally to vaporize a portion of the stabilized crude oil which will be reinjected above the withdrawal point of the latter.

Whether or not the distillation stage is preceded by a decompression stage of the virgin crude oil, the minimum pressure within the distillation column is chosen so as to avoid reaching a temperature of less than 0° C. at the head of the column. The internal pressure of the column will generally be between 4 bars and 15 bars.

Another subject of the invention is the device implementing the said process. This device is characterized in that it contains at least one distillation column comprising a pipe introducing the crude oil charge to be distilled and at least two withdrawal pipes, one for the gaseous $C_4$ and $C_5$ hydrocarbon cut containing a portion of $C_3$ hydrocarbons at the head of the column and the other, for the crude oil cut, below the injection point for the virgin crude oil into the column.

This distillation column is connected at the head of the column to at least one selective separation circuit via the withdrawal pipe for the gaseous cut and via a pipe for injection of the mostly $C_4$ and $C_5$ liquid hydrocarbons, situated below the withdrawal point of the said gaseous cut from the column.

The selective separation circuit advantageously comprises at least one selective separator for gaseous hydrocarbons, chosen from the group of the separators comprising cryogenic groups, adsorption/desorption reactors and selective membrane separators, and at least one gas/liquid condenser.

The preferred selective separation circuit of the invention contains at least one adsorption/desorption reactor filled with at least one adsorbent chosen from the group comprising active charcoals, slag residues and molecular sieves.

In a specific embodiment of the device of the invention, the circuit comprises at least two active charcoal reactors, operating alternately for the continuous implementation of the process for adsorption/desorption of the gases, as selective adsorber reactor of the gases or as desorber reactor. In order to accelerate the desorption, a stream of steam is conveyed over the active charcoal, which requires an additional stage of drying the latter. As the sum of the desorption time of the gases and drying time of the active charcoal is at most equal to the adsorption time of the latter, the desorption and drying operations of the first reactor will easily take place while the gases are being adsorbed on the active charcoal of the second reactor.

With the aim of removing any trace of $C_3$ hydrocarbons in the hydrocarbons recycled at the head of the column, a unit known as a depropanizer unit will advantageously be arranged downstream of the said selective separator in the circuit which is bringing back $C_4$ and $C_5$ hydrocarbons in order to adjust the quality of the recycle to the requirements of the process.

The present device, according to the invention, advantageously comprises, upstream of the distillation column, a unit for partial decompression of the virgin crude oil, comprising a chamber in the form of an ovoid drum comprising, in its upper part, an extension comparable to a mini distillation column containing at least two theoretical plates, said chamber containing an inlet pipe for the virgin crude oil, a discharge pipe for the water separated by settling in its lower part, an outlet pipe for the decompressed crude oil, to which the absorption liquid laden with $C_4$ to $C_7$ hydrocarbons has been added, a discharge pipe for the light hydrocarbons, mostly $C_1$ and $C_5$ hydrocarbons, at the upper end of the extension and an inlet pipe for the absorption liquid.

In another embodiment of the device, the unit for partial decompression of the virgin crude oil can be replaced by a partial decompression circuit comprising a device characterized in that it comprises, upstream of the distillation column, a circuit for partial decompression of the virgin crude oil comprising a chamber for decompression of the virgin oil connected, via a discharge pipe for the gases, to a column for separation/absorption of the degassed $C_1$ to $C_7$ hydrocarbons, comprising an outlet pipe for the $C_1$ to $C_3$ gases, an inlet pipe for the absorption liquid and an outlet pipe for the absorption liquid laden with $C_4$ to $C_7$ hydrocarbons, and comprising a discharge pipe for the decompressed crude oil to a mixing/settling chamber comprising an inlet pipe for the absorption liquid laden with $C_4$ to $C_7$ hydrocarbons, an outlet pipe for the water which has separated by settling and an outlet pipe for the crude oil/absorption liquid mixture to be distilled.

In a first embodiment of the device, the withdrawal pipe for the stabilized crude oil is situated at the bottom of the column. The distillation column is then connected at the bottom of the column to a circuit for recycling a portion of the stabilized crude oil equipped with a reboiler via the withdrawal pipe for the stabilized crude oil and via an injection pipe for the vaporized crude oil situated above the said withdrawal pipe.

In a second embodiment of the device according to the invention, the distillation column comprises at least three withdrawal pipes, one for the gaseous cut at the head of the column, one for the stabilized crude oil in the median part of the column and finally one for the heavy hydrocarbon cut at the bottom of the column. In this preferred device, the outlet pipe for the said heavy cut is connected to the inlet pipe for the absorption liquid in the chamber of the decompression unit, in order to recycle the heavy hydrocarbon cut as absorption liquid.

In this specific mode of the device of the invention, the distillation column is connected, at the head of the column, to a circuit for selective separation of the gaseous cut via the withdrawal and injection pipes described above and, at the bottom of the column, to a recycle circuit comprising a reboiler via the withdrawal pipe for the said heavy cut and via an injection pipe situated above this withdrawal point.

Optionally, the column can be connected, in its median part, to a circuit for recycling stabilized crude oil equipped with a reboiler via a second withdrawal pipe situated at the same level as the withdrawal pipe for the stabilized crude oil and via an injection pipe for the vaporized crude oil situated above this said second withdrawal pipe. This recycle of vaporized stabilized crude oil makes it possible to improve the economics of the stabilization process according to the invention. This recycle has the effect of heating the charge of the crude oil/absorption liquid mixture entering into the column. In a specific embodiment of the device of the invention, with a view to limiting the consumption of energy in vaporizing the heavy cut in the reboiler of the recycle circuit, the trays or the packing present in the median part of the column, above the withdrawal point for the stabilized crude oil, can advantageously be replaced by a device for exchanges of matter and heat which has the same separating function as the trays or as the packing but which additionally makes it possible to reheat the charge in the column.

In this embodiment of the invention, the device additionally comprises at least two exchangers, the first being placed on the pipe introducing the absorption liquid into the decompression chamber, for the purposes of cooling it as far as possible, and the second on the discharge pipe for the stabilized crude oil, in order to bring the latter to the required storage temperature.

The process according to the invention and its device will be easily transposable by those skilled in the art to the treatment of condensate fields which are essentially gas pools containing $C_1$ to $C_4$ hydrocarbons. In these fields, the aim is not to stabilize the fluids but rather to recover liquid condensates of $C_4$ to $C_8$ hydrocarbons. Of course, in the process combining a decompression stage with the distillation stage, a hydrocarbon cut distilling between 200° and 300° C., preferably gas oil, will be introduced into the fluids to be distilled and recycled as absorption liquid.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

BEST MODE FOR CARRYING OUT THE INVENTION

Figure 1:
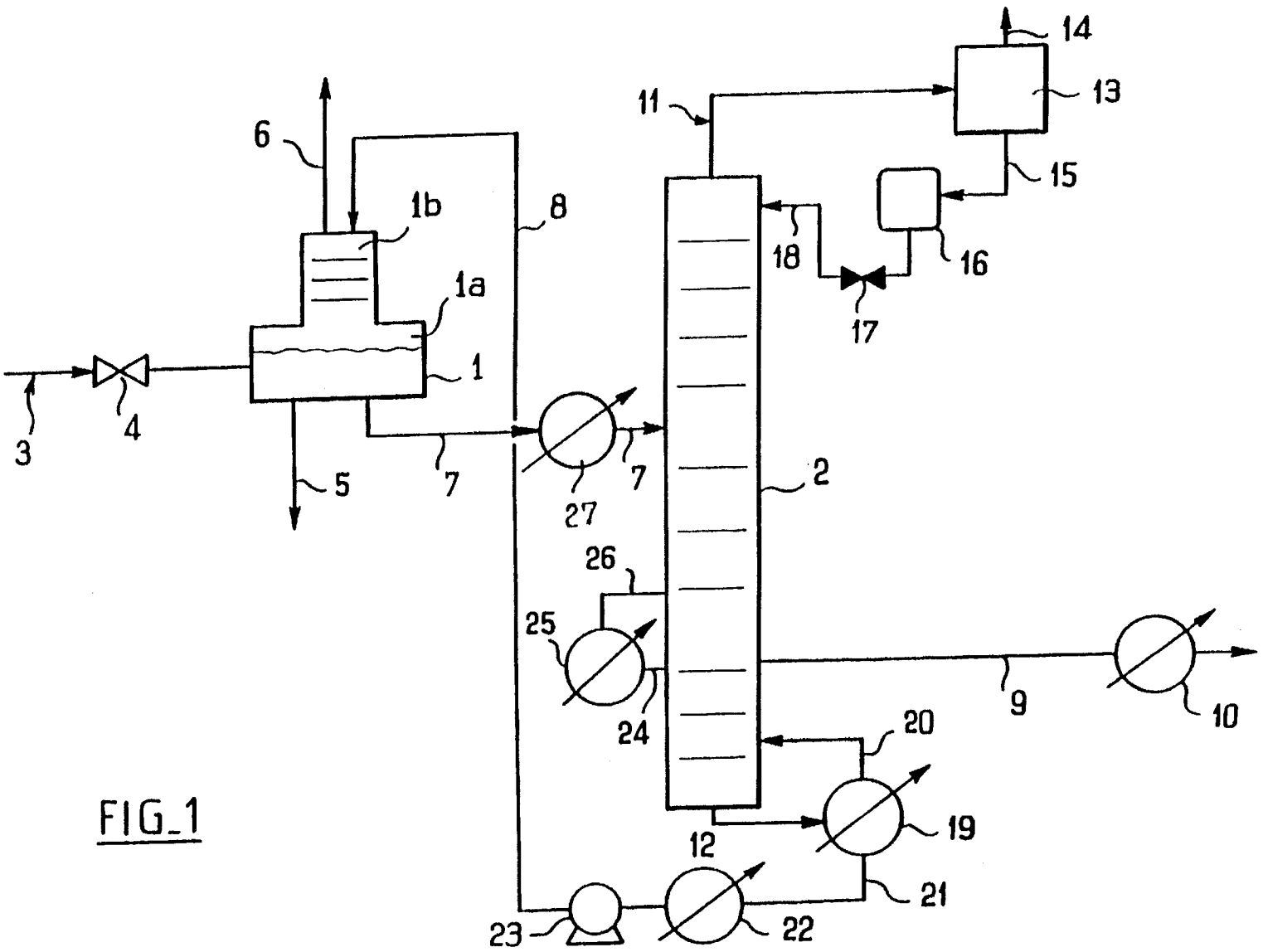
FIG. 1 shows a first device of the invention.

The device of FIG. 1 comprises a unit 1 for decompression of the virgin crude oil arriving via the pipe 3 and a distillation column 2, dimensioned in order to have from 10 to 30 theoretical plates, connected to the unit 1 via the pipe 7. The unit 1 is a closed chamber comprising a drum la surmounted by a mini column 1*b* dimensioned in order to have at least two theoretical plates.

The virgin crude oil reduced in pressure via the valve 4 and entering into the drum 1*a* via the pipe 3 is decompressed. Under the effect of the decompression, a portion of the $C_4$ to $C_7$ hydrocarbons is vaporized and is carried into the mini column 1*b* where these hydrocarbons are separated. A portion of the $C_4$ to $C_7$ hydrocarbons thus falls back into the drum 1*a*. In order to recover all these $C_4$ to $C_7$ hydrocarbons, a hydrocarbon liquid, known as absorption liquid, which is stable at the temperature and at the pressure of the chamber 1, is injected countercurrentwise to the gas flow, close to the discharge point for the non-condensable $C_1$ and $C_2$ hydrocarbons via the pipe 6, at the head of the mini column, via the pipe 8. In falling back into the drum 1*a*, the absorption liquid mixes with the crude oil and with the non-settled formation water, the whole mixture being discharged from the chamber 1 via the pipe 7. The water settled in the drum 1*a* is discharged via the pipe 5.

At the outlet of the chamber 1, the water/crude oil/absorption liquid mixture can pass through an exchanger 27 which makes it possible to lower the temperature of the mixture before it enters into the distillation column 2. At the head of the column, the $C_1$ to $C_5$ hydrocarbon cut is discharged via the pipe 11 and then conveyed into a selective separation unit 13 which will make it possible to recover all the condensed $C_4$ and $C_5$ hydrocarbons and a portion of the $C_3$ hydrocarbons which will be directed towards a knockout drum 16 via the pipe 15 and then reinjected at the head of the column via the pipe 18 in order to create a liquid reflux in the latter. A valve judiciously placed on the pipe 11 makes it possible to regulate the internal pressure of the distillation column 2. At the same time, the $C_1$ and $C_2$ hydrocarbons and the remainder of the unrecovered $C_3$ hydrocarbons are discharged from the separation unit 13 via the pipe 14 in order, for example, to be flared off.

In the median part of the column 2, the stabilized crude oil is discharged via the withdrawal pipe 9 and its temperature is then lowered by making it pass through the exchanger 10 in order to bring it to a temperature which allows it to be stored. However, in order to adjust the vapor pressure of the stabilized crude oil, a second withdrawal of the stabilized crude oil is carried out at the same level as the previous, via the pipe 24. The oil passes through a reboiler 25 in which it is partially vaporized before being reinjected into the column 2 above its withdrawal point via the pipe 26. The reinjection of the partially vaporized crude oil makes it possible to obtain a better separation from the light $C_1$ and $C_2$ hydrocarbons capable of still being trapped therein. At the bottom of the column, the heavy hydrocarbon cut is withdrawn via the pipe 12 and then directed towards the reboiler 19 in order to be partially vaporized therein. The hydrocarbon vapors are reinjected into the column 2 via the pipe 20 whereas the thermally stable heavy cut is recovered via the line 21 and recycled as absorption liquid in the mini column 1*b* of the chamber 1 via the exchanger 22, the pump 23 and then the pipe 8. This partial vaporization of the said cut makes it possible to obtain a stabilized crude oil cut with a perfectly controlled composition.

Figure 2:
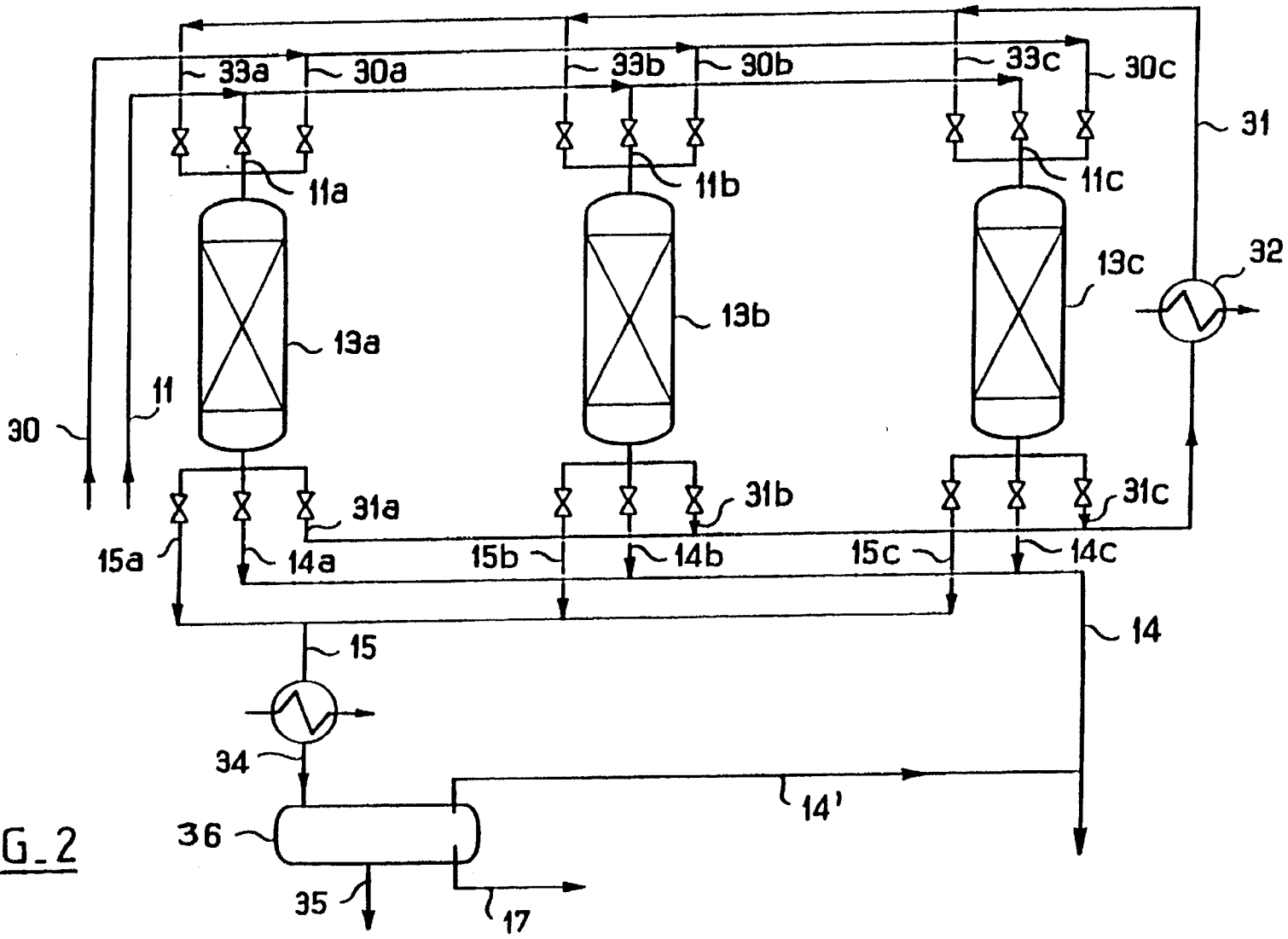
FIG. 2 shows a selective separation circuit of the device.

In FIG. 2, a representation is given of a separation unit comprising three reactors 13*a*, 13*b* and 13*c*, filled with active charcoal, each of them corresponding to a different treatment stage.

Thus, the reactor 13*a* corresponds to a stage of adsorption of the $C_1$ to $C_5$ hydrocarbons withdrawn from the distillation column 1 via the pipe 11, the reactor 13*b* corresponds to a stage of desorption with steam of the hydrocarbons trapped on the active charcoal and the reactor 13*c* corresponds to a stage of drying the active charcoal with dry gaseous hydrocarbons not previously trapped on the active charcoal, that is to say $C_1$ and $C_2$ hydrocarbons.

During the adsorption of the hydrocarbons, the latter arrive on the reactor 13*a* via the pipe 11: the valves placed on the other access lines to the latter, 11b and 11c, are closed. Only the $C_3^+$ hydrocarbons, preferentially the $C_5$ hydrocarbons, then the $C_4$ hydrocarbons, and, finally, partially the $C_3$ hydrocarbons will be trapped on the active charcoal, whereas the gaseous $C_1$ and $C_2$ hydrocarbons, not trapped by the active charcoal, will be discharged via the line 31a in order to rejoin the line 51 and to be recycled, after reheating in the exchanger 52, for the drying of the active charcoal of the reactor 13c via the line 33c, the valves of the access lines 53a and 53b to the reactors 13a and 13b being closed.

During the desorption, the line 30 introduces steam, generated for example by a boiler, onto the active charcoal of the reactor 13b via the line 30b, the valves of the access lines 30a and 30c to the reactors 13a and 13c being closed. Under the effect of the steam, the adsorbed hydrocarbons desorb, preferentially the $C_3$ hydrocarbons, then the $C_4$ hydrocarbons and finally the $C_5$ hydrocarbons, and are directed via the line 15b into the pipe 15. They pass through a condenser 56 and are then introduced into the water disengaging drum 36 where the condensates are discharged via the line 55 towards a water treatment unit. The residual $C_1$ and $C_2$ hydrocarbons are conveyed via the line 14' to the line 14 leading to the flare, and the liquid $C_3^+$ hydrocarbons are conveyed via the pipe 17 towards the knockout drum 16. The valves of the lines 14b and 31b are closed.

In order to dry the active charcoal of the reactor 13c, the recycled dry gaseous hydrocarbons arriving in the reactor 13c via the line 33c are discharged via the line 14c, the valves of the lines 15c and 31c being closed. They are led towards the line 14 in order to be flared off.

When the adsorption stage in the reactor 13a is finished, the latter generally being the longest, the stage of desorption of the hydrocarbons is begun. The drying of the active charcoal in the reactor 13b and the adsorption of the gaseous hydrocarbons arising from the distillation column 2 in the reactor 13c are begun at the same time. It is sufficient, for this adsorption/desorption process, to switch around the stages in the reactors in order to understand how the process operates continuously.

Figure 3:
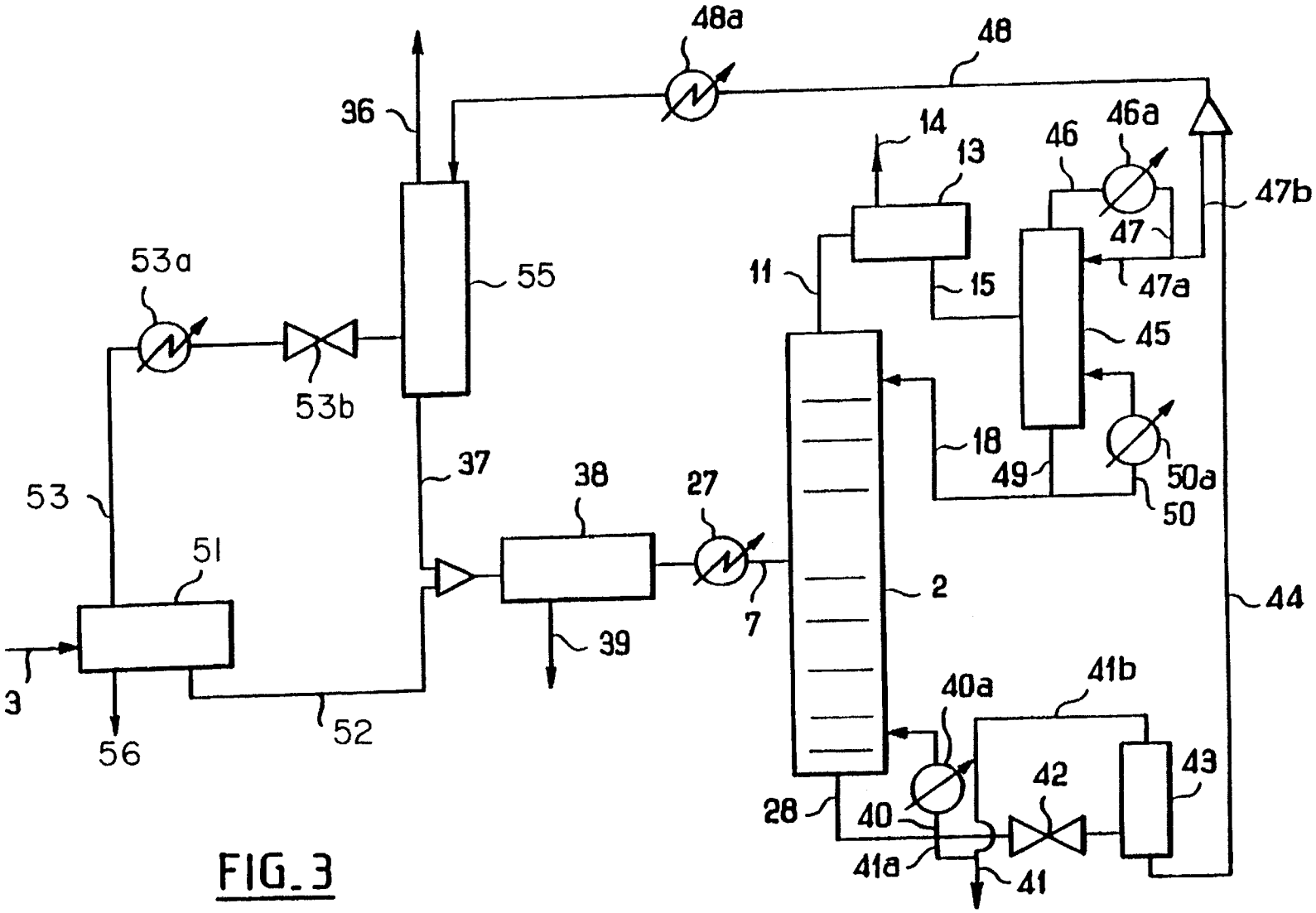
FIG. 3 shows a second device of the invention.

The device of FIG. 3 comprises a decompression circuit comprising a chamber 51a for partial decompression connected, on the one hand, to the inlet pipe 3 for the virgin crude oil and, on the other hand, to a column 55 for separation/absorption of the degassed $C_1$ to $C_7$ hydrocarbons and to a mixing/settling chamber 38, said column 55 being itself connected to the said chamber 38, and a distillation column 2.

The virgin crude oil arriving via the pipe 3 is reduced in pressure in the partial decompression chamber 51a. The $C_4$ to $C_7$ hydrocarbons are vaporized and carried, with the light $C_1$ to $C_3$ hydrocarbons, towards the separation/absorption column 55 via the outlet pipe which passes through the exchanger 53a and the valve 53b. In said column 55, the $C_1$ to $C_3$ hydrocarbons are discharged via the outlet pipe 36, the absorption liquid is introduced via the inlet pipe 48 and, finally, the absorption liquid laden with recovered $C_4$ to $C_7$ hydrocarbons is discharged via the outlet pipe 37 connected to the inlet pipe to the mixing/settling chamber 38.

The crude oil, partially decompressed in the chamber 51a, is conveyed via the pipe 32 into the mixing/settling chamber 38 where it is mixed with the absorption liquid laden with $C_4$ to $C_7$ hydrocarbons and then discharged via the pipe 7.

Settled virgin water is discharged via the pipe 56 from the chamber 51a and via the pipe 39 from the chamber 38.

At the outlet of the chamber 38, the water/crude oil/absorption liquid mixture passes through an exchanger 27 in order to lower the temperature of the mixture before it enters into the column 2.

At the head of the column 2, the $C_1$ to $C_5$ hydrocarbon cut is discharged via the pipe 11 and then conveyed into a selective separation unit 13 comprising a pipe 14 for discharge of the $C_1$ to $C_3$ hydrocarbons and a pipe 15 which conveys the condensed $C_4$ and $C_5$ hydrocarbons, still laden with $C_3$ hydrocarbons, towards a depropanizer 45. Most of the purified $C_4$ and $C_5$ hydrocarbons are reinjected at the head of the column via the pipes 49 and then 18.

The depropanizer, operating as a distillation column, comprises a reboiling circuit (pipe 50, reboiler 50a) at the bottom of the depropanizer and a recycle circuit, connected via the pipes 46 and 47a to the head of the depropanizer, comprising an air-cooled exchanger 46a.

The stabilized crude oil is recovered at the bottom of the column 2 via the pipe 28 connected, moreover, to a reboiling circuit, via the pipe 40, comprising a reboiler 40a.

A portion of this stabilized crude oil from the pipe 28 is reduced in pressure by means of the valve 42, causing partial vaporization of the $C_3$ to $C_8$ hydrocarbons, and it is then conveyed into the chamber 43 where the vapor and liquid phases are separated. The vapor phase, returned via the pipe 41b, rejoins the stabilized crude oil directly recovered at the bottom of the column 2 via the pipes 28 and then 41a, in order to be discharged via the pipe 41.

Another portion of the stabilized crude oil discharged from the chamber 43 via the pipe 44 is recycled in the column 35 as absorption liquid. It can be partially laden with $C_2$ to $C_4$ hydrocarbons coming from the depropanizer 45 via the pipe 47b.

In this device according to FIG. 3, the use of a depropanizer 45 is particularly advantageous because only the advantageous hydrocarbons are returned to the distillation column 2 and because it additionally makes it possible to limit the size of the selective separation unit. Moreover, this depropanizer 45 brings about good flexibility which makes it possible to produce either solely crude oil or simultaneously liquified gases and crude oil.

In order to verify the behavior of the process according to the invention, an example is given below without implied limitation.

EXAMPLE

The present example is targeted at comparing the behavior of the process according to the invention with that of the prior art used.

For the art used prior to the invention, a system containing at least three flash drums making it possible to decompress the virgin crude oil with departures of decompression vapors laden essentially with gas, such as nitrogen, carbon dioxide and $C_1$ and $C_2$ hydrocarbons, for the first drum and heavier hydrocarbons for the other drums, is installed at the outlet of the extraction well. If the specific case of the Palanca field is taken, the virgin crude oil leaves with a pressure of 40 bars, at a temperature of approximately 48° C. and a flow rate of approximately 350 t/h (tonne/hour). In the first decompression drum, the pressure is brought back to 27 bars and the vaporized gases are discharged from the drum and then led to the flare in order to be flared off, whereas the decompressed crude oil is directed towards a second decompression drum. In this second drum, the crude oil is decompressed from 27 to 6 bars; as above, the vaporized gases are conveyed to the flare and the decompressed crude oil is conveyed into a third and last drum in which its pressure is brought back to 1.2 bars.

For the present invention, the virgin crude oil conveyed into the chamber 1 is decompressed from 40 to 27 bars and only the gaseous $C_1$ and $C_2$ hydrocarbons are vaporized and discharged towards the flare in order to be flared off therein with a flow rate of 37 t/h. The crude oil, to which the absorption liquid laden with $C_3$, $C_4$ and $C_1$ hydrocarbons is added, is discharged from the chamber 1 at a flow rate of 382 t/h and a temperature of 48° C. It is cooled to 40° C. in the exchanger 27 and is then introduced into the distillation column. The stabilized crude oil is collected at a temperature of 117° C., at atmospheric pressure and at a flow rate of 293 t/h via the pipe 9 at the outlet of the column. The Reid vapour pressure of the recycle, in the median part of the column, is of the order of 0.69 bar at 38° C. and the pressure in the column is 8.5 bars.

Degrees of recovery of the vaporizable $C_4$ to $C_7$ hydrocarbons for the stabilization process corresponding to the prior art (A) and the stabilization process according to the invention (X) are collated in the table below.

TABLE

| | A | X |
|---|---|---|
| $N_2$ | $10^{-5}$ | 0 |
| $CO_2$ | 1.5 | 0 |
| $C_1$ | 0.06 | 0 |
| $C_2$ | 2.6 | 0.02 |
| $C_3$ | 17.43 | 36.76 |
| $C_4$ | 49.8 | 93.81 |
| $C_5$ | 77.65 | 98.42 |
| $C_6$ | 94.56 | 98.66 |
| $C_7$ | 99.6 | 99.78 |
| $C_8$ | 100 | 100 |
| $C_9$ | 100 | 100 |
| $C_{10}$ | 100 | 100 |
| $C_{11}^+$ | 100 | 100 |
| Water | 67.7 | 67.7 |

It is observed that the degrees of recovery of hydrocarbon compounds according to the present invention are considerably greater than those of the prior art. Virtually all the value-enhanceable $C_3^+$ hydrocarbons are recovered, for a Reid vapor pressure of 0.69 bar.

We claim:

1. A process for the stabilization of virgin crude oil at the outlet of a well, utilizing least one separation stage, which comprises:

feeding the crude oil under a well outlet pressure of 10–100 bars to a decompression unit;

decompressing said crude oil by said decompression unit;

feeding the decompressed crude oil to at least one distillation column; and distilling said depressurized crude oil under pressure in the at least one distillation column utilizing at least two cuts, including a gaseous $C_1$ to $C_5$ hydrocarbon cut recovered at the head of the column and a stabilized crude oil cut recovered below an injection point of said crude oil into the column; wherein the gaseous cut is selectively separated into two fractions, one fraction comprising light $C_3^-$ hydrocarbons and the other fraction comprising $C_4$ and $C_5$ hydrocarbons and a portion of the $C_3$ hydrocarbons;

and further wherein only the $C_4$ and $C_5$ hydrocarbons is recovered, then condensed and finally reinjected at the head of the column.

2. The process according to claim 1, wherein the virgin crude oil is distilled as two cuts and wherein said gaseous cut is at the head of the column and the stabilized crude oil cut is at the bottom of the column.

3. The process according to claim 2, wherein a portion of the stabilized crude oil cut is vaporized and then reinjected at the bottom of the column.

4. The process according to claim 1, wherein the selective separation of the gaseous cut is obtained by a method selected from the group consisting of cryogenics, adsorption/desorption and membrane separation of the gases.

5. The process according to claim 1, wherein the fraction containing $C_3$ to $C_5$ hydrocarbons is depropanized.

6. The process according to claim 1, wherein said decompression comprises partially degassing said virgin crude oil, absorbing essentially the vaporized $C_4$ to $C_7$ hydrocarbons in an absorption liquid, mixing said absorption liquid laden with $C_4$ to $C_7$ hydrocarbons with said degassed oil and separating by settling a portion of the formation water extracted from the well with said crude oil.

7. The process according to claim 6, wherein the degassing, absorption, mixing and separation by settling operations are carried out simultaneously in one of the same chamber and separate chambers.

8. The process according to claim 6, wherein the crude oil is decompressed for a degree of decompression of between 1 and 7.

9. The process according to claim 6, wherein the absorption liquid is introduced countercurrentwise to the gas flow in order to trap the $C_4$ to $C_7$ hydrocarbons degassed during the decompression of the crude oil.

10. The process according to claim 9, wherein the absorption liquid is a hydrocarbon selected from the group consisting of the distillation cuts of the stabilized crude oil and the stabilized crude oil.

11. The process of claim 1, wherein the virgin crude oil entering into the distillation column is distilled as at least three cuts, including a gaseous $C_1$ to $C_5$ hydrocarbon cut drawn off at the head of the column, a stabilized crude oil cut drawn off from the median part of the column and a heavy hydrocarbon cut, drawn off at the bottom of the column, including hydrocarbons having at least eight carbon atoms per molecule.

12. The process according to claim 11, wherein a portion of the heavy hydrocarbon cut is vaporized and then reinjected at the bottom of the column.

13. The process according to claim 11, wherein said heavy hydrocarbon cut is recycled as absorption liquid in the decompression stage.

14. The process according to claim 11, wherein a portion of the stabilized crude oil cut is vaporized, which comprises reinjecting the vaporized portion into the median part of the column above a withdrawal point of the stabilized crude oil from the column.

15. The process according to claim 1, wherein the internal pressure of the distillation column is between 4 bars and 15 bars.

16. A device stabilizing crude oil which comprises:

at least one distillation column connected to a feed pipe which includes a deliver pipe delivering virgin crude oil charge to a decompression unit and a distillation column; said distillation column having at least two withdrawal pipes respectively withdrawing gaseous hydrocarbon cut at a head of the column and stabilized crude oil cut below an injection point for the crude oil into the column; wherein the column is connected at the head of the column to at least one selective separation circuit via the withdrawal pipe for the gaseous hydrocarbon cut and via a pipe for injecting $C_4$ and $C_5$ liquid hydrocarbons, situated below the withdrawal point of said gaseous cut from the column.

17. The device according to claim 16, wherein the withdrawal pipe for the stabilized crude oil is situated at the bottom of the column.

18. The device according to claim 17, wherein the distillation column is connected at the bottom of the column to a circuit for recycling a portion of the stabilized crude oil, equipped with a reboiler, via the withdrawal pipe for the stabilized crude oil and via an injection pipe for the vaporized crude oil situated above the said withdrawal pipe.

19. The device according to claim 16, wherein the selective separation circuit comprises at least one selective separator for gaseous hydrocarbons selected from the group of separators consisting of cryogenic groups, adsorption/desorption reactors and selective membrane separators, and at least one gas/liquid condenser.

20. The device according to claim 19, wherein the selective separation circuit contains at least one adsorption/desorption reactor filled with at least one adsorbent selected from the group consisting of active charcoals, slag residues and molecular sieves.

21. The device according to claim 19, wherein the selective separation circuit comprises at least two active charcoal reactors operating alternately for the continuous implementation of the stages of adsorption and desorption of the hydrocarbons.

22. The device according to claim 19, further comprising at least one depropanizer located downstream of said selective separation circuit.

23. The device according to claim 16, wherein the decompression unit is located upstream of the distillation column, said decompression unit partially decompressing the crude oil and including a closed chamber in the form of an ovoid drum having, in an upper part thereof, an extension containing at least two theoretical plate, said chamber containing at least two theoretical plates, said chamber containing an inlet pipe for the nonstabilized crude oil, a discharge pipe for the formation water separated by settling in a lower part of the unit, an outlet pipe for the decompressed crude oil, to which the absorption liquid laden with $C_4$ to $C_7$ hydrocarbons has been added, and a discharge pipe for light $C_1$ and $C_2$ hydrocarbons at the upper end of the extension and an inlet pipe for the absorption liquid.

24. The device according to claim 16, wherein the decompression unit comprises, upstream of the distillation column, a circuit partially decompressing the virgin crude oil, said circuit comprising a decompression chamber connected, via a discharge pipe for the gases, to a column for separation/absorption of the degassed $C_1$ to $C_7$ hydrocarbons, said circuit including an outlet pipe for the gases, an inlet pipe for the absorption liquid and an outlet pipe for the absorption liquid laden with $C_4$ to $C_7$ hydrocarbons, a discharge pipe discharging the decompressed crude oil to a mixing/settling chamber having an inlet pipe for the absorption liquid laden with $C_4$ to $C_7$ hydrocarbons, and an outlet pipe for the water which has separated by settling and an outlet pipe for the water/crude oil/absorption liquid mixture to be distilled.

25. The device according to claim 16, wherein the distillation column comprises at least three withdrawal pipes including a first pipe for the gaseous cut at the head of the column, a second pipe for the stabilized crude oil cut in the median part of the column and a third pipe for the heavy hydrocarbon cut at the bottom of the column.

26. The device according to claim 25, wherein the outlet pipe for the heavy hydrocarbon cut is connected to the inlet pipe for the absorption liquid in the chamber of the decompression unit.

27. The device according to claim 25, wherein the column is connected at the head of the column to a circuit for selective separation of the gaseous cut via withdrawal and injection pipes and, at the bottom of the column, to a recycle circuit comprising a reboiler via the withdrawal pipe for said heavy cut and via an injection pipe situated above said withdrawal point.

28. The device according to claim 25, wherein the column is connected in a median part thereof to at least one circuit having a reboiler recycling a portion of the stabilized crude oil via a second withdrawal pipe arranged at the same level as the withdrawal pipe for the stabilized crude oil and via an injection pipe for the vaporized crude oil situated above said second withdrawal pipe.

29. The device according to claim 25, further comprising at least a first and second exchanger, said first exchanger introducing the absorption liquid into the chamber and said second exchanger being connected to the discharge pipe for the stabilized crude oil.

* * * * *